United States Patent [19]

Hashimoto et al.

[11] Patent Number: 4,504,163

[45] Date of Patent: Mar. 12, 1985

[54] MECHANICAL PENCIL WITH AUTOMATIC LEAD ADVANCE

[75] Inventors: Junichi Hashimoto, Tokyo; Tomozo Sekiguchi, Kawasaki, both of Japan

[73] Assignee: Pentel Kabushiki Kaisha, Tokyo, Japan

[21] Appl. No.: 525,798

[22] Filed: Aug. 24, 1983

Related U.S. Application Data

[63] Continuation of Ser. No. 244,326, Mar. 16, 1981, abandoned.

[30] Foreign Application Priority Data

| | | | |
|---|---|---|---|
| Mar. 31, 1980 | [JP] | Japan | 55-40156 |
| Jun. 30, 1980 | [JP] | Japan | 55-88854 |
| Oct. 31, 1980 | [JP] | Japan | 55-155911[U] |
| Feb. 19, 1981 | [JP] | Japan | 56-21432[U] |

[51] Int. Cl.[3] ..... B43K 21/16

[52] U.S. Cl. ..... 401/53; 401/65; 401/70; 401/80; 401/81

[58] Field of Search ..... 401/53, 54, 65, 67, 401/80, 81, 94

[56] References Cited

U.S. PATENT DOCUMENTS

| | | | |
|---|---|---|---|
| 2,865,330 | 12/1958 | Swank | 120/17 |
| 3,424,535 | 1/1969 | Schischkow | 401/53 |
| 4,180,339 | 12/1979 | Katz | 401/67 |
| 4,211,500 | 7/1980 | Hashimoto | 401/65 |
| 4,270,870 | 6/1981 | Hashimoto et al. | 401/94 X |
| 4,275,971 | 6/1981 | Katz | 401/65 X |

FOREIGN PATENT DOCUMENTS

| | | | |
|---|---|---|---|
| 2837586 | 3/1980 | Fed. Rep. of Germany | 401/65 |
| 2929855 | 3/1981 | Fed. Rep. of Germany | 401/65 |
| 54-14823 | 2/1979 | Japan . | |
| 55-5350 | 2/1980 | Japan . | |
| 2001011 | 1/1979 | United Kingdom | 401/67 |

*Primary Examiner*—Steven A. Bratlie

*Attorney, Agent, or Firm*—Wenderoth, Lind & Ponack

[57] ABSTRACT

A mechanical pencil having a writing point tube slidably mounted on the forward end portion of a pencil casing, an annular slider device slidably mounted within the pencil casing and having a lead retainer, a first spring for urging the writing point tube in the forward direction, a collet chuck mechanism having a lead engaging collet and a chuck-actuation cylinder, a second spring urging both the lead engaging collet and the chuck-actuation cylinder in the opposite direction and a third spring for urging the collet chuck mechanism in the forward direction. The pencil has a locking device for temporarily engaging the slider at its retracted position, and a pusher for releasing the engagement of the slider. When an axial thrust is applied to the writing tip of the pencil for lead advancement, the slider and the collet chuck mechanism as well are retracted within the pencil casing with their positional relation being unchanged. When the thrust against the writing tip is released, the collet chuck mechanism is advanced at first with the lead grasped therein to feed the lead out of the lead tube while the slider is temporarily engaged at its retracted position, and thereafter the pusher abuts against the slider to unlock it so that the slider advances by the effect of the first spring with the lead projecting from the lead tube.

14 Claims, 28 Drawing Figures

MECHANICAL PENCIL WITH AUTOMATIC LEAD ADVANCE

This application is a continuation of now abandoned application Ser. No. 244,326 filed 3-16-81.

BACKGROUND OF THE INVENTION

The present invention relates to an automatic writing instrument which is constructed to feed the writing lead into writing position merely through application of pressure or thrust against the writing point end of the pencil, or against the writing tip of the lead itself. More particularly, the present invention relates to a mechanical pencil of the type described above in which a slider having a lead retainer and a projectable tube is urged rearwardly through the application of pressure against the writing point end against a resilient force of a spring device mounted within a pencil casing together with the lead in the tube, and the lead is advanced from the writing end of the tube for a predetermined distance after the pressure or thrust is released.

U.S. Pat. No. 2,865,330 to E. V. Swank shows a similar type of the writing instrument which is constructed to both feed and retract the writing lead into and out of writing position through application of thrust against the writing point end of the pencil, or against the writing tip of the lead. In the known writing instrument, a sleeve for clamping a lead engaging collet chuck is designed to be held or suspended temporarily when the writing point end, i.e., a slidable tube or the writing tip of the lead, is pressed by the application of the thrust. When the thrust is released, the lead in the lead engaging collet chuck is advanced, and then the temporary suspension of the collet chuck is released to advance the sleeve so that the lead is advanced from the writing point of the sleeve. However, the pencil disclosed in the above-described U.S. Pat. No. 2,865,330 incorporates a comparatively complex device for temporarily holding the lead engaging collet chuck.

Japanese Patent Application No. 53-77570 published under publication No. 54-14823 on Feb. 3, 1979 shows a similar type of pencil, in which a tubular writing point and a lead retainer are caused to slide or be retracted through application of a pressure against the writing point with a lead engaging collet chuck being held still. In the pencil, when the pressure on the tubular writing point is released to permit the tubular writing point to advance to the former position, the lead engaged by the lead retainer can be advanced to the end of the tubular writing point, while, however, the lead is not advanced any further from the very end of the tubular writing point since the lead engaging collet chuck is not designed to retract by the application of a pressure against the tubular writing point. In order to advance the lead so as to cause it to project from the end of the writing point in writing position, a push-button or similar manually actuated controls must be actuated.

Another structure of the similar type of the writing instrument is shown in Jananese Utility Model Application No. 51-141854 published under Publication No. 55-5350 on Feb. 7, 1980 in which the writing instrument incorporates, for the purpose of retaining a tubular writing point at a predetermined projected position, a sleeve frictionally engaged with a tubular slider such that the frictional resistance force therebetween is designed to be greater than the frictional resistance force between the lead and the lead engaging collet chuck.

However, the lead projection must be conducted by actuation of a push-button.

SUMMARY OF THE INVENTION

An object of the present invention is to provide an automatic mechanical pencil which is constructed to feed the lead to a projected writing position merely through application of pressure or thrust against the writing point end of the pencil, or against the writing tip of the lead itself.

Another object of the present invention is to provide a mechanical pencil which has a simple construction relative to the known pencil of the type described.

Still another object of the present invention is to provide an improved mechanical pencil which permits a reliable operation of the lead advancement to a writing position merely through application of pressure against the writing point end of the pencil, or against the writing tip of the lead itself.

Briefly, the mechanical pencil according to the present invention has, basically, a writing point tube slidably mounted at a forward end portion of a pencil casing, an annular slider device slidably mounted within the pencil casing and having a lead retainer, a first spring for urging the writing point tube in the forward direction, a collet chuck mechanism having a lead engaging collet and a chuck-actuation cylinder, a second spring urging the both lead engaging collet and the chuck-actuation cylinder in the opposite direction and a third spring for urging the collet chuck mechanism in the forward direction. The collet chuck mechanism, when the slider is retracted, is retractable through the lead against the resilient force of the third spring with its position relative to the slider being maintained, and the chuck actuation cylinder coacts with a magazine for leads. A washer or locking ring is mounted coaxially with the slidable writing point tube for engaging the slider. The locking ring is designed such that the engagement force of the locking ring is greater than the resilient force of the first spring. The chuck-actuation cylinder is provided with a pusher for releasing the engagement between the locking ring and the slider when the collet chuck mechanism is advanced from the retracted position. The pusher is positioned in an opposing relation to the rear end of the slider.

In another embodiment of the invention, a friction tube is connected to a forward end of the magazine, with its forward portion being frictionally engaged with the chuck-actuation cylinder. The lead engaging collet has at its rearward end an abutment for receiving or engaging with a forward end of the magazine. The third spring is disposed between the chuck-actuation cylinder and the magazine to urge both elements in the opposite direction to a regular position of the elements. In the regular or normal positional state, the forward end of the chuck-actuation cylinder is in an opposing relation relative to the rearward end of the slider in a regular positional state with a distance or space therebetween, the distance being smaller than the retracting distance of the slider. A projection and shoulder may be formed on the outer surface of the chuck-actuation cylinder and on the inner surface of the pencil casing, respectively, so that the projection can be engaged with the shoulder when the chuck-actuation cylinder is retracted. The locking ring for retaining the slider at the predetermined position, when the slider is retracted, may be attached either to a stationary element such as an inner wall of the pencil casing or an outer surface of the slider.

Other objects and features of the present invention will become apparent from the detailed description of preferred embodiments thereof, which will be made with reference to the accompanying drawings. It is to be understood that the accompanying drawings and description are for the purpose of illustration only and do not limit the invention.

DETAILED DESCRIPTION OF THE INVENTION

Figure 1:
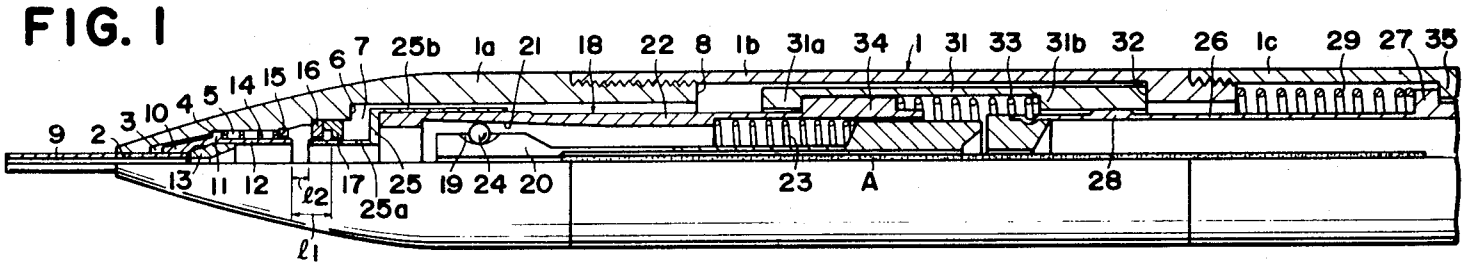
FIGS. 1 through 8 are sectional views of one embodiment of the mechanical pencil of the invention showing, in turn, an operational mode and movement of pencil elements.

Referring to the drawings, like reference numerals represent like parts in the different and various views of the drawings, wherein the rearward end portion of the inventive pencil is not illustrated, the structure thereof being apparent from the description hereinafter and understood from the known mechanical pencil as well as from the following description.

Referring first to FIG. 1, a mechanical pencil has a slidable writing point tube 9 which is projectable from a central aperture 2 of a tubular pencil casing designated generally at 1, and a slider 10 of a tubular shape having therein a tubular lead retainer 13. The slidable tube 9 and the slider 10 are slidably mounted within the casing 1 for movement from a projected position inwardly into the casing against the resilient force of a first spring 14. The casing 1 has a forward part 1*a*, middle part 1*b* and rearward part 1*c*, the three parts being releasably engaged and together making up the shape of the pencil as illustrated. The forward part 1*a* which has a front part of truncated conical shape in cross section is centrally aperture to provide a tapered bore 3, shoulder 4, cylindrical bore 5, shoulder 6 and cylindrical bore 7 of larger diameter then bore 5, and terminates in a rear end 8. The slider 10 is fixed to the slidable tube 9 and mounted within the forward part 1*a*. The slider 10 is provided with an annular projection 11 which is capable of abutment against the shoulder 4, and a cylindrical portion 12 extended rearwardly from the annular projection 11. Within the slider 10 is provided a lead retainer 13 of desired resilient materials, which is designed to function to resist reverse movement of a lead during slider retraction and to aid an advancing movement of the lead when the slider advances or travels in the forward writing point end direction. Accordingly, the lead retainer 13 which is annular shaped in the illustrated embodiment may have any other desired shape such as a C-shaped ring, or otherwise the lead retainer may be omitted by providing a frictional engagement between the inner wall of the slidable tube 9 and the lead as suggested by the aforementioned U.S. patent. The slider 10 is axially slidable but generally urged by the first spring 14 toward the writing tip so that the annular projection 11 abuts against the shoulder. The first spring 14 is mounted around the cylindrical portion 12 of the slider 10, and between the annular projection 11 and spring receiver 15, the latter being fixed to the inner wall of the forward part 1*a* of the casing 1.

Between the spring receiver 15 and the shoulder 6 in the casing 1 is disposed a locking ring or washer 16 which has a slider-retaining force greater than the resilient recovery force of the first spring. When the slider 10 is fully retracted, it is held at the retracted position against the resilient force of the first spring 14, for the purpose of lead advancement through application of a pressure against the writing point end of the pencil. Namely, if a collet chuck mechanism 18, which will be described later in detail, can be retracted while maintaining its positional relation relative to the slider 10, and does not disturb the lead which is advanced together with the lead retainer 13 when the temporarily retained slider 10 advances, the lead can be advanced or projected from the slidable tube 9 through application of the pressure against the writing point end of the pencil by commencing a forward returning of the slider 10 with a delay of certain period of time as from a commencement of a forward returning of the collet chuck mechanism. In the simplest way of forming the locking ring 16, it may be formed of a metal-made or rubber-made ring having an inner diameter slightly smaller than the outer diameter of the cylindrical portion 12 of the slider 10, but not limited to the structure described above. If desired, though not shown, a recess may be formed in the cylindrical portion 12 and a projection formed on the locking ring 16 to engage with the recess, or a slit or slits can formed in the cylindrical portion 12 to provide the portion 12 with resiliency for engaging with the locking ring 16.

In the illustrated embodiment, a stop 17 is shown for limiting the retraction of the slider by abutment of an end of the cylindrical portion 12 against the stop. The stop 17 can, however, be deleted since the maximum retraction distance is naturally limited by the first spring 14. The length or distance of retraction of the slider 10 limited by the stop 17 will be referred to and designated by $l_1$ hereinafter. The slider 10 is retracted generally by manually holding the pencil in normal or preferably vertical writing position and pushing downwardly on the pencil with the slidable tube 9 in contact against a stationary object such as, for example, a writing paper or a table surface.

The collet chuck mechanism 18 is shown as comprising a lead engaging collet 20 incorporating a split collar and recessed seats 19 for nesting rotary elements 24, which will be described later in detail, a chuck-actuation cylinder 22 having a tapered guide surface 21, and a second helical spring 23 mounted between the collet 20 and the chuck-actuation cylinder 22. The collet chuck mechanism is assembled such that the rotary elements such as balls 24 received by the seats 19 can exhibit a "wedge" function relative to the tapered guide surface 21 of the chuck-actuation cylinder 22. The collet chuch mechanism 18 may have any other desired configuration such as shown, for example, in the aforementioned U.S. Patent in which the collet has a tapered cam surface and a chuck actuation cylinder is engaged against the tapered cam surface.

In the illustrated embodiment, a cylindrical pusher 25 is provided having a forward portion 25*a* coaxially aligned with the cylindrical portion 12 of the slider 10 and a rearward portion 25*b* fixed to the chuck-actuation cylinder 22. The pusher 25 is ordinarily opposing the rear end of the slider 10 at the space or distance or $l_2$ as shown in FIG. 1, but engageable with the slider 10 to release the temporary engagement between the slider and the locking ring so that it can push the slider in the forward direction when the collet chuck mechanism 18 is advanced from its retracted position.

The length of the lead advanced by application of a pressure against the writing point end will be determined by the value of $l_2$ as will be described later in detail. To this end, it is necessary that both the collet chuck mechanism 18 and slider 10 can retract with their relative position being maintained fixed. Besides, the lead should be advanced by a constant length by overcoming the resistance between the lead and the lead retainer 13 after the lead drops due to its own weight down to the lead retainer 13 through the lead engaging collet 20.

The above-described lead advancing operation can be achieved by the combination of an axially slidable pipe 31, a third helical spring 33 and a fourth helical spring 29. More specifically, the magazine 26 has a projection 27 on its outer surface, and the fourth spring 29 is mounted between the rear end of the middle part 1*b* of the casing and the projection 27 to urge the magazine in the rearward direction. The magazine 26 is provided with a frictionally engaging portion 28 which frictionally contacts the slidable pipe 31. The slidable pipe 31 abuts against a shoulder 32 of the middle part 1*b* of the casing to limit its retraction. The slidable pipe 31 has a recess in its inner wall to define a front shoulder 31*a* and a rear shoulder 31*b* which the chuck-actuation cylinder 22 has on its outer surface an abutment 34 which is urged to abut against the front shoulder 31*a* by means of the third spring 33. Thus, the position of the chuck-actuation cylinder 22 is determined. The reference numerals 27 and 35 are a projection on the magazine 26 and a shoulder on the rearward part 1*c* of the casing, respectively, to prevent the magazine 26 from coming out of the casing.

Figure 10:
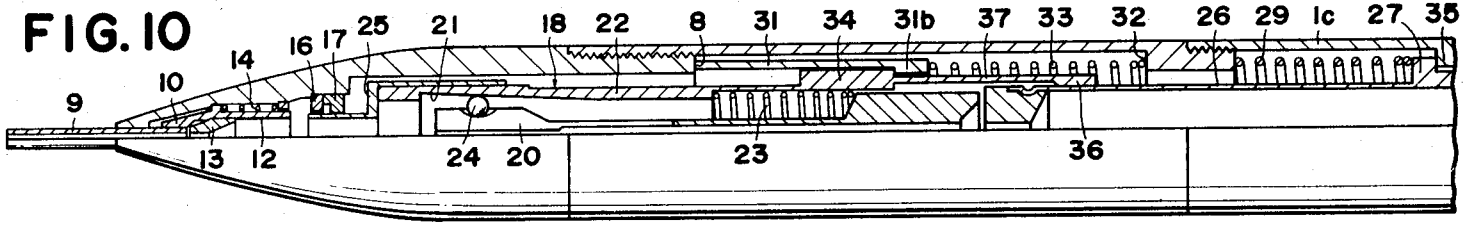
FIG. 10 is a sectional view of a mechanical pencil according to another embodiment of the invention, showing pencil elements in a position corresponding to the positional relation of the pencil elements shown in FIG. 1, FIGS. 11 through 14 are sectional views of the mechanical pencil according to a further embodiment of the invention, showing, in turn, an operational mode and the positional relation of the pencil elements.

In FIG. 10 which shows a modified structure of the chuck-actuation mechanism 18 of the pencil shown in FIG. 1, the third spring 33 is mounted between the rear end of the slidable pipe 31 and the shoulder 32 of the middle part 1*b* of the casing to urge the slidable pipe 31 against the rear end 8 of the forward part 1*a* of the casing. The slidable pipe 31 has a shoulder 31*b* at its end to abut against the abutment 34 under the force of the third spring 33. The chuck-actuation cylinder 22 is provided with an extended portion 37 which projects rearwardly from the abutment 34 and has a frictionally engaging portion 36. The portion 36 frictionally engages the outer surface of the magazine 26 which is urged rearwardly by means of the fourth spring 29.

Figure 2:
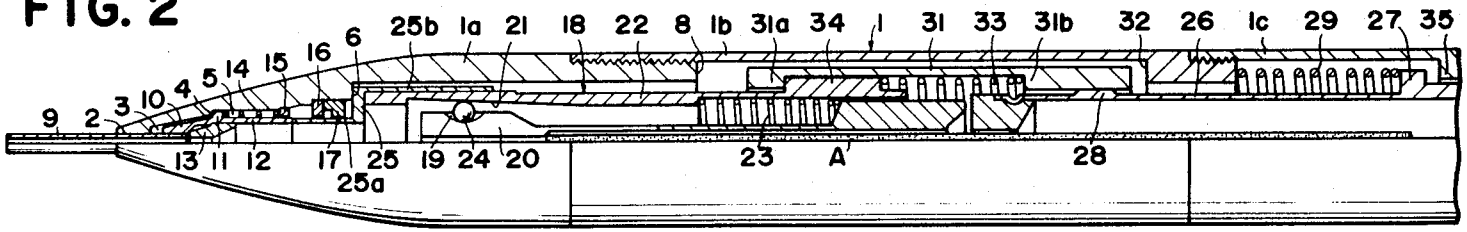

The operation will be described with reference to FIGS. 1 through 8. In the first place, it is assumed, by way of clarification, that the lead engaging collet is closed to prevent the lead, which is designated by reference A, from being advanced as illustrated in FIG. 1. With the pencil in the more or less vertical position with the forward part 1*a* down, when a pressure or thrust is applied against a push-button projecting from the rear end of the casing 1, not shown for the purpose of simplification only, to cause the magazine 26 to feed in the forward direction, the slidable pipe 31 in frictional engagement with the engaging portion 28 of the magazine 26, chuck-actuation cylinder 22 having the abutment 34 urged against the slidable pipe 31, and the lead engaging collet 20 which is releasably engaged with the chuck-actuation cylinder 22 by means of the balls 24 and tapered guide surface 21 are advanced together to cause the pusher 25 of the chuck-actuation cylinder to contact the cylindrical portion 12 of the slider, as illustrated in FIG. 2.

Figure 3:
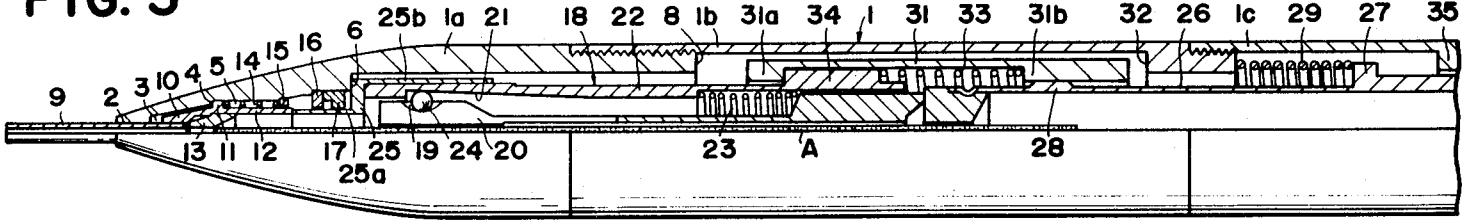

When the magazine 26 is advanced further, the magazine slides at the frictionally engaging portion 28 relative to the slidable pipe 31 with the axial length of the third helical spring 33 being almost unchanged because the third spring 33 is designed to have a resilient force greater than the frictional engagement force between the portion 28 of the magazine 26 and the slidable pipe 31, and thereafter, the lead engaging collet 20 is pushed forward by the magazine 26 to cause the axial length of the second spring 23 to be reduced. Thus, only the lead engaging collet is advanced while the slidable pipe 31 maintains its position. This means that the balls 24 secured in the recesses 19 of the collet 20 are moved together with the collet in the forward direction to cause the collet 20 to open. Accordingly, the lead A drops due to its own weight to the lead retainer 13 as shown in FIG. 3.

Figure 4:
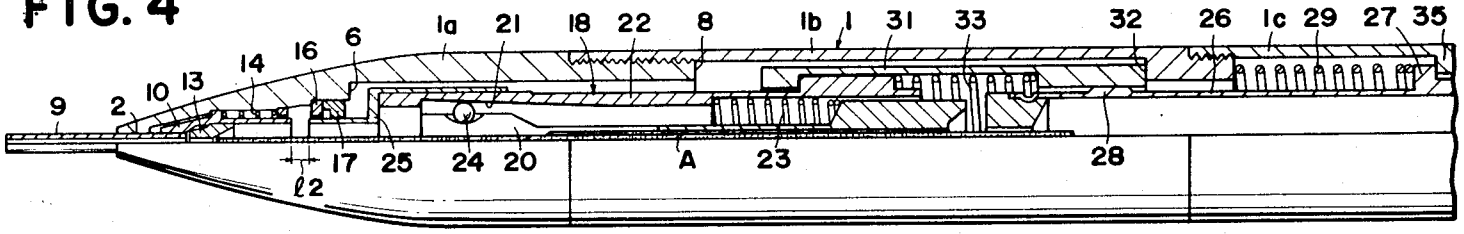

When the pressure against the push-button is released, the magazine 26, slidable pipe 31 and collet chuck mechanism 18 are retracted by the fourth helical spring 29 with their positional relation being fixed, namely with the collet being open, until the rear end of the slidable pipe 31 abuts against the shoulder 32 of the casing 1. Thus, the retraction of both the slidable pipe 31 and chuck-actuation mechanism 22 is completed, but both the lead engaging collet 20 and magazine 26 continue their retraction. Namely, the lead engaging collet 20 continues to retract by means of the recovery force of the second spring 23 to a position where the collet 20 begins to engage the lead, while the magazine 26 continues to retract to a position where the frictional engaging portion 28 of the magazine is in full frictional engagement with the slidable pipe 31, as illustrated in FIG. 4.

It will be understood from the foregoing that repeated manipulation of the push-button (not shown) forces the lead to advance into the lead retainer 13 and to project from the tube 9 or writing point by a length necessary for writing.

Figure 5:
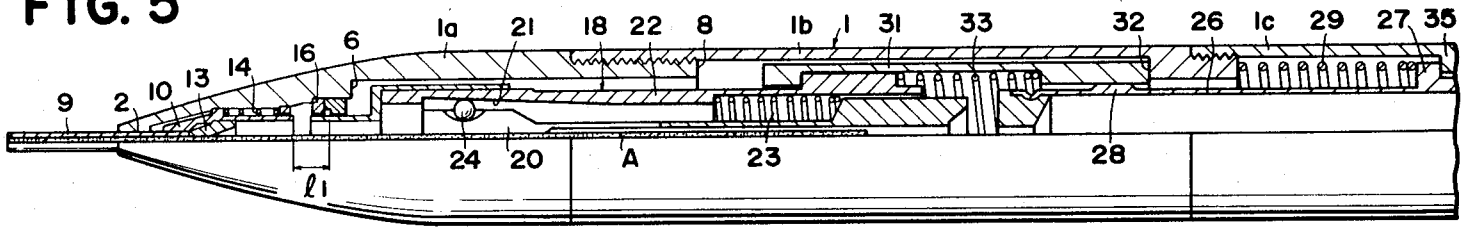
Figure 6:
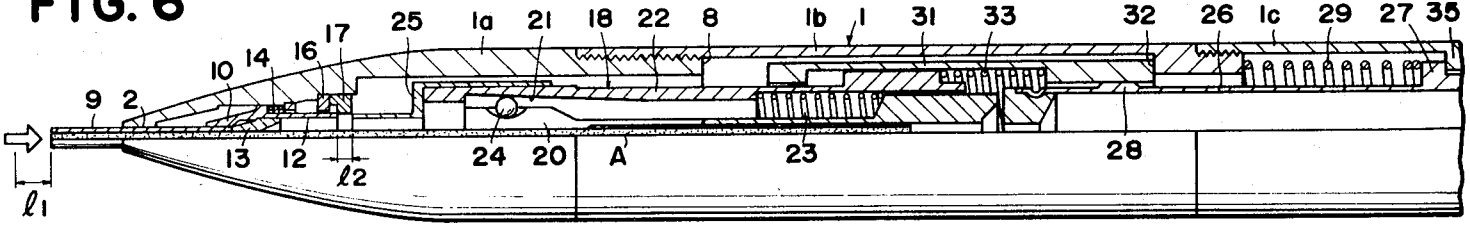
Figure 7:
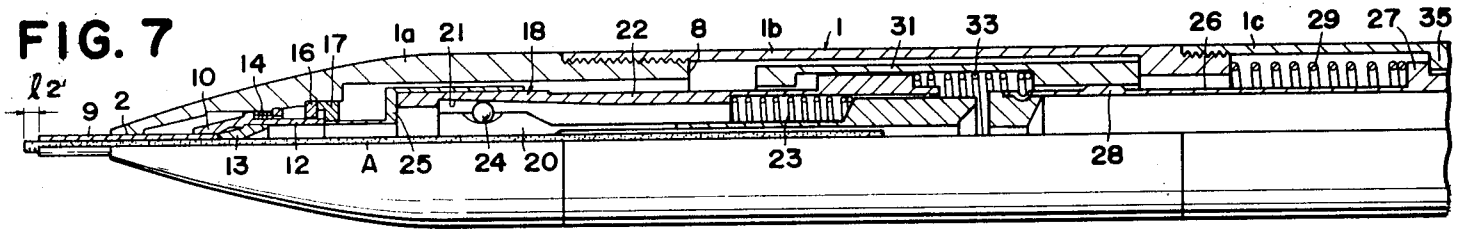

When the projected lead is worn or used up by normal writing, the lead can be projected suitably by application of a pressure or thrust against the writing point end of the slidable tube 9, which will be described hereinafter with reference to FIGS. 5 through 8. FIG. 5 shows that the lead extends to the end of the slidable writing point tube 9 but is not extended beyond the tube 9. When a pressure is applied against the tube 9 as well as the lead by manually holding the pencil in a vertical writing position and pushing downwardly on the pencil with the lead tip as well as the tube 9 in contact against a stationary object, such as, for example, a writing paper to cause retraction until the cylindrical portion 12 of the slider abuts the stop, the collet chuck mechanism 18 which has grasped the lead is retracted against the third spring 33 through the distance $l_1$ which is equal to the distance of the slidable tube 9 is retracted. Distance $l_2$ between the cylindrical portion 12 and the pusher 25 is maintained as illustrated in FIG. 6. After that, the pressure of the thrust applied to the slidable tube 9 is released. In this instance, the slider 10 is subjected to the resilient recovery force of the first spring 14 which has been compressed through the distance $l_1$, but the slider 10 is temporarily held at its retracted position by the temporary engagement between the cylindrical portion 12 of the slider 10 and the locking ring 16 since the temporary engagement force is designed to be greater than the recovery force of the first spring 14. Thus, the slidable tube 9 remains in its retracted position, as illustrated in FIG. 7. On the other hand, the third spring 33 which has received the compressional force and been compressed through the distance $l_1$ urges, by its greater recovery force, the collet chuck mechanism 18 in the forward direction, and the lead grasped by the collet 20 is also advanced through the lead retainer 13 of the slider 10 since the frictional engagement force between the locking ring 16 and the slider 10 is greater than the frictional engagement between the lead retainer 13 and the lead. When the lead is advanced through the distance $l_2$, the pusher 25 abuts the cylindrical portion 12 of the slider, as illustrated in FIG. 7. It is seen that at this point the lead is extended beyond the end of the slidable tube 9 by the distance $l_2$.

Figure 8:
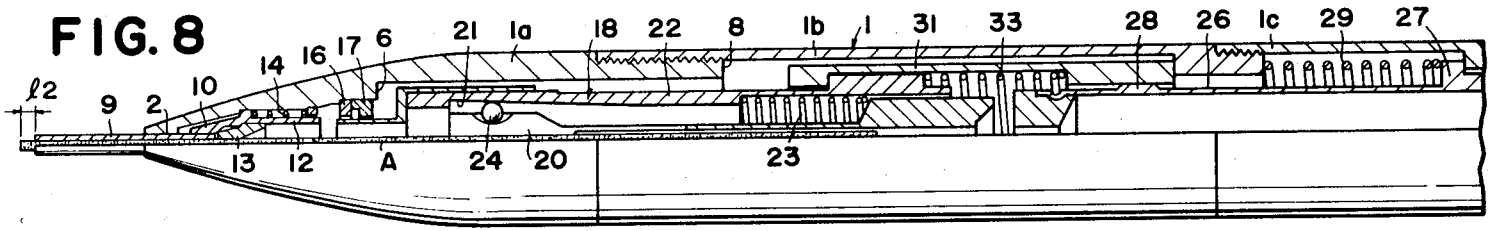
Figure 9:
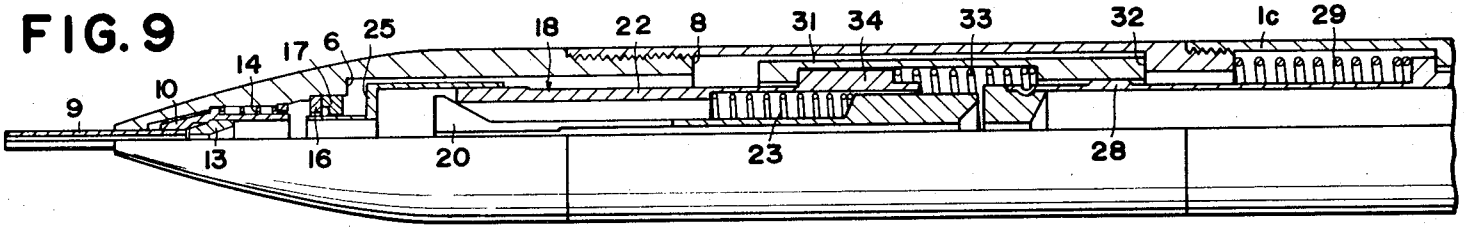
FIG. 9 is a sectional view of a modified structure of the mechanical pencil incorporating a collet chuck mechanism and associated parts thereof.

The pusher 25 strikes the slider 10 to cause the slider to advance against the engagement force of the locking ring 16 together with the lead A held by the lead retainer 13 through the distance $l_1$. The collet chuck mechanism 18 advances the remaining distance, namely a distance of $l_1$ minus $l_2$, to complete the movement of the various pencil elements as shown in FIG. 8. The advancing or returning distance of the collet chuck mechanism 18 is smaller than the advancing distance of the slider 10, and the first spring has a smaller recovery force than the third spring. Accordingly, the collet chuck mechanism advances earlier than the slider does. In this case, after the lead is advanced so as to extend the distance $l_2$ from the writing point end of the pencil, by the frictional engagement of the lead retainer 13 with the lead, the collet 20 also is advanced further while the spring 23 is compressed to cause the balls 24 to be positioned at an enlarged diameter portion, i.e., the forward portion, of the tapered guide surface 21. Therefore, the grasping force of the collet 20 is released, and the lead together with the slider 10 and tube 9 is advanced the distance $l_1$. The length $l_2$ the lead extends from the slidable tube 9 is unchanged in the stages of FIGS. 7 and 8.

The aforementioned operational mode is the same for the modified structure of the pencil as illustrated in FIG. 10.

According to the mechanical pencil which has been described with reference to FIGS. 1 through 10, the locking ring 16 has an engagement force greater than the recovery force of the first spring 14 so that the slider 10 is temporarily engaged with or retained by the locking ring 16. Besides, the chuck-actuation mechanism 22 has a pusher 25 which can push the slider in the forward direction against the engagement force of the locking ring 16 when the collet chuck mechanism 18 is advanced from its retracted position.

FIGS. 11 to 14 show another embodiment of the present invention. The pencil casing 1 has a connecting tube **1*d* for connecting the middle part 1*b* and the rearward part 1*c*. The forward part 1*c* has a central aperture 2 and a tapered bore 3, the latter defining a first shoulder 4, a second shoulder 5*a* and third shoulder 6 to form at least three different diameter cylindrical inner walls. A locking ring 16 and a cylindrical member 30 are mounted in the cylindrical inner wall defined by the second and third shoulders 5*a* and 6 such that the locking ring 16 is fixedly positioned between the second shoulder 5*a* and a cylindrical member 30. The cylindrical member 30 has a shoulder 30*a* for limiting the retraction of a slider 10**, which will be described in detail.

The slider 10 which is provided with the tube 9 has an integral annular projection 11 and a cylindrical portion 12. A lead retainer 13 is rigidly mounted on the slider 10. A first helical spring 14 is disposed between the projection 11 on the slider 10 and the rear reduced diameter portion of the cylindrical member 30 so that the projection 11 abuts against the first shoulder 4 to determine a normal position of the slider 10. However, if a sufficient pressure or axial thrust is applied against the writing tip end of the tube 9 by manually holding the pencil vertically and pushing downwardly on the pencil with the tube in contact against a stationary object, the slider is retracted from the normal position until it is retracted a distance $l_1$ and abuts against the shoulder **30*a* of the cylindrical member 30. During the retraction, the slider 10 will retract in a smooth motion to the locking member 16, but a further retraction requires a further thrust since the inner diameter of the locking member 16 is smaller than the outer diameter of the annular projection 11 of the slider 10. The slider-engaging force $F_s$, i.e. frictional engaging force, of the locking ring 16 is designed to be greater than the recovery force of the first spring 14 so that the slider 10** can be retained at its retracted position.

The collet chuck mechanism 18 is similar in structure to the collet chuck mechanism described with reference to FIG. 1 and has a lead engaging collet 20, a chuck-actuation cylinder 22 with a tapered guide surface 21 and balls 24 positioned in a recessed seat 19 of the collet 20. A second spring 23 is mounted between the collet 20 and the chuck-actuation cylinder 22. Considering that the lead grasping force of the lead retainer 13 is $F_g$, it is desired that the force $F_2$ of the second spring 23 be designed to be smaller than the lead grasping force $F_g$ so that the collet 20 may be advanced together with the lead retainer 13 which is grasping the lead.

The chuck-actuation cylinder 23, which is axially movable, has at its forward outer surface a projection **22*a* which coacts with a forward end 40 of the middle part 1*b* of the casing 1 to prevent the lead from advancing excessively, which will be described later in detail. The chuck-actuation cylinder 22 has, on its middle outer suface, an annular shoulder 41 and a cylindrical portion 42 of reduced diameter. An annular spring-receiver 43 for receiving the forward end of a third spring 33 is slidably mounted on the cylindrical portion but limited in its forward movement by the shoulder 41**.

A magazine 26 for containing therein leads is axially movable and guided by the inner surface of the connecting tube 1*d*. The magazine 26 is rigidly connected to a friction tube 45, which has an annular projection 46, through a connector 44. The friction tube 45 is frictionally engaged with the cylindrical portion 42 of the reduced diameter of the chuck-actuation cylinder 22. Reference numeral 50 designates a portion deformed for the purpose of imparting the desired frictional engagement with the cylindrical portion 42.

The third helical spring 33 is disposed between the annular projection 46 and the spring receiver 43 to urge the spring receiver 43 against the inner forward end of the middle part 1*b* of the casing and to urge the annular projection 46 against the connecting tube 1*d*. Thus a normal position of the chuck-actuation cylinder and of the magazine 26 will be determined. If the normal position of the chuck-actuation cylinder 22 is determined, the position of the lead engaging collet is inevitably determined. The connector 44 has an extended end 48 which can abut against and push a reception portion 47 integrally formed with the collet 20, and a recess to define an end 49 which is in a spaced confronting relation with the rear end of the chuck-actuation cylinder 22.

When the slider 10, collet 20, chuck-actuation cylinder 22 and magazine 26 are in their normal position, all of these parts and associated elements should be designed such that the following unequities are satisfied:

$l_2 < l_1 < l_3 < l_4$ and $l_5 < l_3 < l_4$ wherein:

$l_1$: retraction distance of the slider 10, $l_2$: distance between the end of the cylindrical portion 12 of the slider 10 confronting the chuck actuation cylinder and the forward end 25 of the chuck-actuation cylinder, $l_3$: distance between the extended end 48 of the connector 44 and the reception portion 47 of the collet 20, $l_4$: distance between the rear end of the reduced cylindrical portion 42 of the chuck-actuation cylinder 22 and the recessed end 49 of the connector 44, and $l_5$: distance between the annular projection 22*a* of the chuck-actuation cylinder 22 and the abutment end 40 of the middle part 1*b* of the casing 1.

Value of $l_2$ should be about 0.5 mm.

As has been described, the recovery force $F_1$ of the first spring is smaller than the grasping or friction-engagement force $F_s$ of the locking ring 16 relative to the slider 10, while the spring force $F_2$ of the second spring 23 is smaller than the lead-grasping force of the lead retainer. Besides, frictional resistance $F_f$ between the friction tube 45 and reduced cylindrical portion 42 of the chuck-actuation cylinder 22 is greater than the force $F_2$ but smaller than the force $F_3$ of the third spring 33 to produce the inequity $F_2 < F_f < F_3$. The values of $F_2$, $F_1$ and $F_g$ are, for example, 6 g, 10 g and 15 g, respectively, while the values $F_s$, $F_f$ and $F_3$ are, for example, 100 g, 100 g and 500, respectively.

The operation of the pencil illustrated in FIGS. 11 to 14 will be described, though it will be understood that the operation is similar to the operation of the previous embodiment shown in FIGS. 1–10.

In order to initially advance the lead which is engaged within the collet 20, an axial pressure is applied against a push-button (not shown) mounted on the rear end of the pencil casing to permit the lead to drop due to its own weight to the lead retainer 13 and then to advance further against the resistance of the lead retainer 13. Since the friction tube 45 connected to the magazine 26 is frictionally engaged with the chuck-actuation cylinder 22 with the frictional resistance $F_f$ while the spring receiver 43 is slidably mounted on the reduced cylindrical portion 42 of the cylinder 22, the advancing or forward movement of the magazine 26 against the resilient force of the third spring 33 will cause a forward movement of the collet chuck mechanism 18. The collet chuck mechanism is advanced the distance $l_2$ and immediately abuts against the rear end of the cylindrical portion of the slider 10 to limit further movement of the chuck-actuation cylinder 22. If the magazine 26 is advanced further, overlapping frictional engagement between the reduced cylindrical portion 42 and the friction tube 45 increases to reduce the distance $l_3$, and finally to push the reception portion 47 of the collet 20, thereby compressing the second spring 23 to advance the lead engaging collet 20 only. This results in movement of the balls 20 along forward portion of the tapered guide surface 21, and consequently, the collet 20 is opened to release the lead-engagement thereof.

When the pressure against the push-button is released to return the chuck-actuation cylinder 22 to its original or normal position, the collet chuck mechanism is returned with its collet being opened until the shoulder 41 of the chuck-actuation cylinder 22 abuts against the spring receiver 43 since the cylinder 22 is frictionally engaged with the friction tube 45. After that, though the extended end 48 of the connector 44 will separate from the reception portion 47, the returning movement of the friction tube 45 will be decelerated by means of the frictional resistance $F_f$ between the friction tube 45 and the reduced cylindrical portion 42. Consequently, recovery of the second spring 23, namely returning of the lead engaging collet 20, is decelerated until it finally grasps the lead A fully. Namely, the lead engaging collect retracts, when the magazine is retracted, with its collet being open and finally grasps the lead. Accordingly, successive manipulation of the push-button permits a desired advancing operation of the lead.

An actuation to cause lead projection by application of pressure or thrust against the writing point end will be described with reference to FIGS. 11 through 14.

Figure 12:
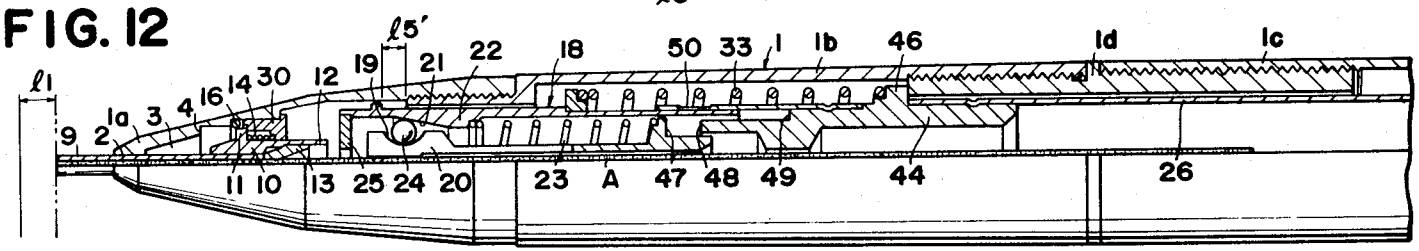

A pressure is applied against the slidable tube 9 as well as the lead A, which has been advanced down to the end of the tube 9, to compress the first spring 14 to retract the slider 10 as well as the tube 9 and lead for the distance $l_1$ until the annular projection 11 abuts against the shoulder 30*a* of the cylindrical member 30. The most convenient method of application of such pressure is to manually hold the pencil vertically relative to a stationary object, such as for example, a table surface or paper surface, and push downwardly on the pencil with the lead tip and tube tip in contact against the stationary object. When the elements such as tube 9 and slider 10 are retracted, the collet chuck mechanism 18 which is grasping the lead is retracted against the third spring 33 with its positional relation relative to the slider being maintained. Namely, the collet chuck mechanism retracts with the distance $l_2$ being maintained constant. Thus, the overlapping area between the chuck actuation mechanism 22 and friction tube 45 increases as illustrated in FIG. 12.

Figure 13:
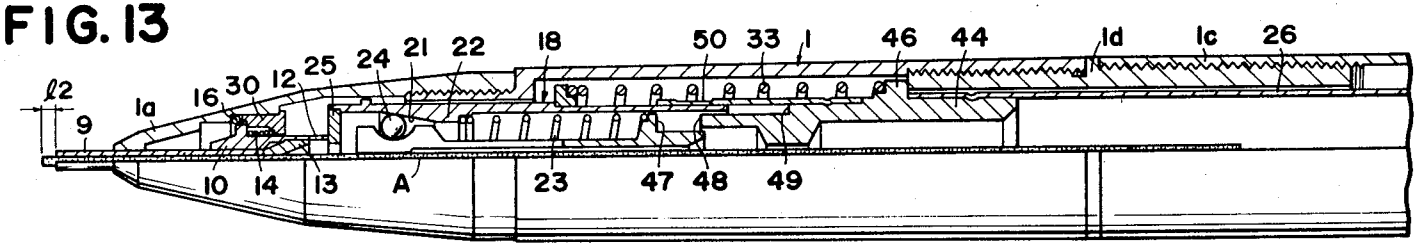

The pressure applied to the writing point end is then released. Since the engagement force $F_s$ of the locking ring 16 is greater than the recovery force of the first spring 14, the slider 10 maintains its retracted position. On the other hand, the collet chuck mechanism 18 is advanced due to the greater recovery force of the third spring 33. This means that the collet chuck mechanism 18 functions to advance the lead A against the resistance of the lead retainer 13. As shown in FIG. 13, the collet chuck mechanism 18 is advanced the distance $l_2$, and therefore the lead is extended by distance $l_2$ from the end of the tube 9, until the pusher 25 of the chuck-actuation cylinder 22 abuts against or strikes the cylindrical portion 12 of the slider 10.

Figure 14:
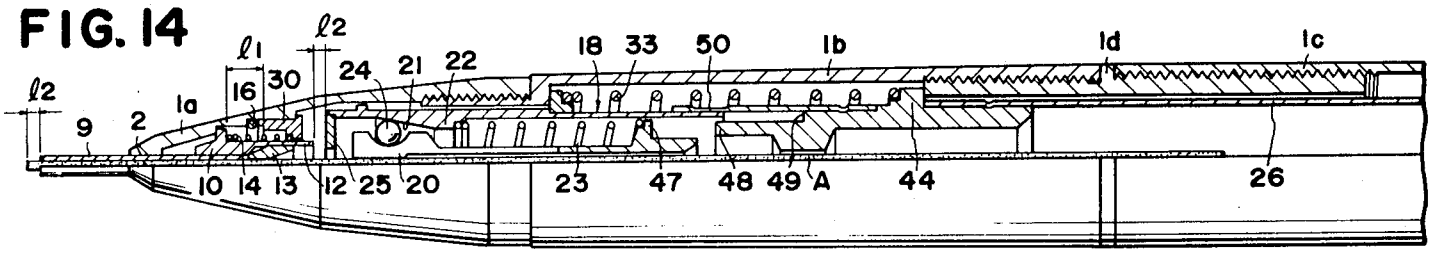

When the slider 10 is pushed by the pusher 25, the slider 10 is moved out of engagement with the locking ring 16 and advances the distance $l_1$ by means of the recovery force of the first spring 14 until the annular projection 11 abuts against the shoulder 4 of the casing 1. The collet chuck mechanism 18, on the other hand, is advanced the remaining distance, namely, the distance $l_1$ minus $l_2$, until the spring receiver 43 abuts against the inner end of the middle part 1*b* of the casing 1, as illustrated in FIG. 14. There is a relative lag between the advance of the slider 10 and the advance of the collet chuck mechanism 18, but these elements can be returned to their normal position with the aforementioned projected condition of the lead being maintained for the following reasons. While the lead held by the lead retainer is forcibly advanced the distance $l_1$ by means of the first spring 14, the chuck-actuation cylinder 22, on the other hand, is decelerated by the frictional resistance so as to advance slowly the distance $(l_1-l_2)$. Since the grasping force $F_g$ of the lead retainer is greater than the force $F_2$ of the second spring 23, the lead which is advanced together with the lead retainer 13 compresses the second spring 23 to feed the lead engaging collet 20 forwardly such that the balls 24 are positioned at an enlarged or greater-diameter portion of the tapered guide surface 21 to decrease or weaken the grasping force of the lead engaging collet 20. Thus, the lead held by the retainer 13 moves together with the slider 10, and therefore, the length of the lead projected from the slidable tube 9 is always $l_2$ and remains unchanged throughout the stages of FIGS. 13 and 14.

The pencil described with reference to FIGS. 11 to 14 functions to prevent excessive projection of the lead from the writing point end of the pencil even though a user tries to apply a pressure successively against the writing tip end. If the lead is projected further in accordance with every step of successive mainpulation of applying such pressure, there will be a danger of lead breakage during writing. The function manner in which a possible excessive lead projection is prevented will now be described.

Figure 11:
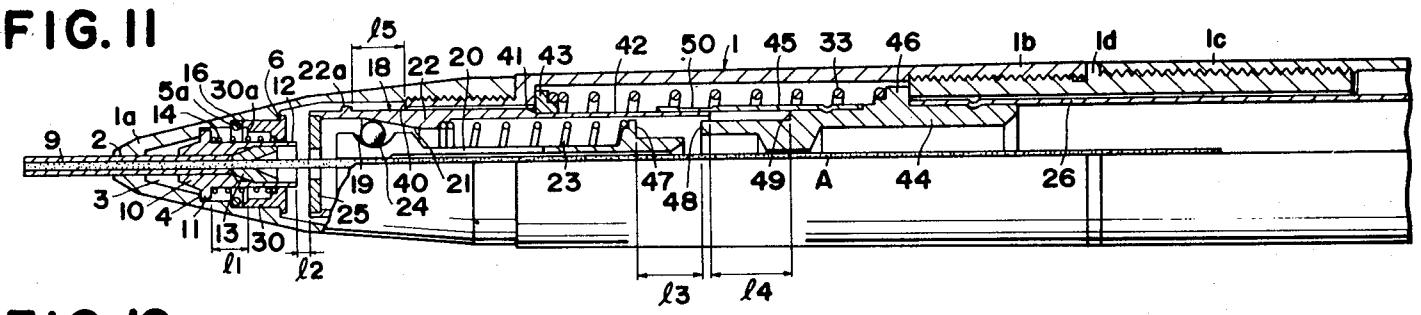

Assuming that a thrust is applied to the projected lead when it is in the position of FIG. 14, the distance the lead will retract will be $l_1+l_2$, which is different from that of the stage shown in FIG. 11. Accordingly, the distance illustrated by $l'_5$ in FIG. 12 will be reduced by the distance $l_2$. Assuming further that the length of the projecting lead is $2l_2$, the distance the lead retracts in that case would be $l_1+2l_2$, and the distance $l'_5$ will be reduced by the distance $2l_2$ which will cause the projection 22*a* to abut the end 40 of the middle part 1*b* of the casing. In this case, however, retractions of the chuck-actuation cylinder 22 and of the collet 20 are not limited by their rear ends since the parts are assembled in a way to satisfy the inequity $l_5<l_3<l_4$. If additional thrust is applied to the projected lead and/or the tube 9 after the projection 22*a* contacts the end 40, it will be understood that the grasping force of the collet 20 increases and that a firm engagement between the collet 20 and the lead is produced. Accordingly, the user can feel a strong resistance and can release the pressure against the lead. Any successive application of pressure against the lead or against the lead and tube will similarly make the user feel the strong resistance. Therefore, the length or distance the lead will project from the slidable tube 9 will be constant.

In the mechanical pencil according to the present invention, slider 10 is locked, though temporarily, by the locking ring 16, and the number of parts can be reduced in comparison with the structure suggested by aforementioned U.S. Pat. No. 2,865,330 which incorporates jaws in the locking collet chuck mechanism.

Figure 15A:
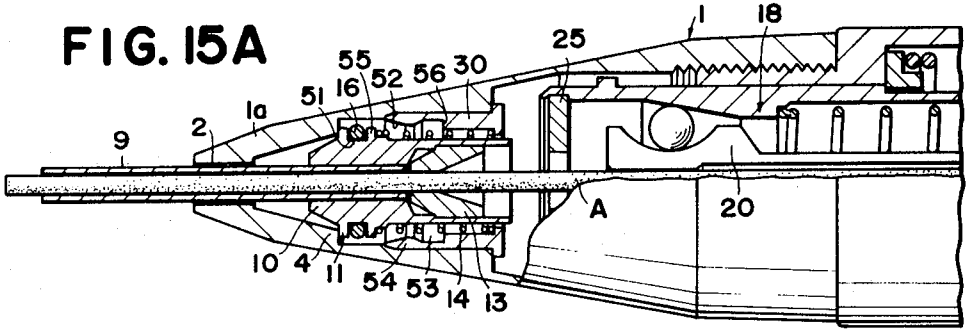
FIGS. 15A, 15B and 15C are sectional views of a part of the mechanical pencil according to a further embodiment of the invention, illustrating a modified structure of a slider and its associated parts and an operational mode, respectively.
Figure 16:
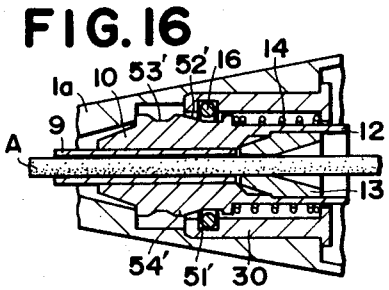
FIG. 16 shows a further modification of the slider and its associated parts.
Figure 15C:
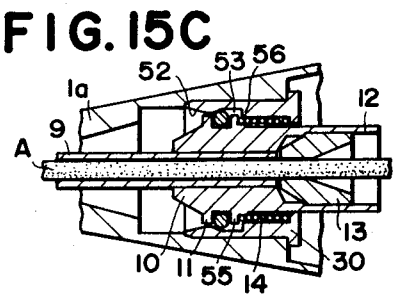
Figure 15B:
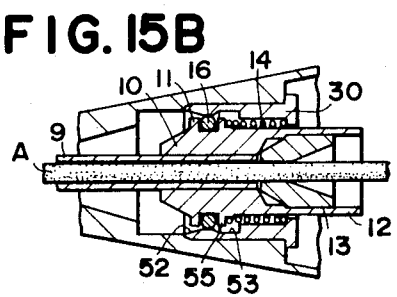

FIGS. 15A, 15B, 15C and 16 show a modified structure exhibiting the aforementioned function to prevent excessive lead projection. FIG. 15A illustrates a locking ring 16, which is generally made of resilient material such as rubber, mounted on the slider 10, while FIG. 16 shows the locking ring 16 mounted on the inner wall of the forward part 1*a* of the casing 1. However, the structure of FIGS. 15A–15C is preferable since the locking ring 16 in the embodiment of FIGS. 15A–15C can be mounted in a stretched condition. The stretched mounting is preferred since a clear "click" sound can be produced when the temporary locking of the slider 10 is completed, which will be described hereinafter.

The part which will coact with the locking ring 16, namely, an inner surface within the forward part 1*a* in FIG. 15A and the outer surface of the slider 10 in FIG. 16, has a tapered portion 52 or 52' and a recess 53 or 53'.

In the embodiment of FIGS. 15A–15C, the slider 10 has a first annular projection 11 which will abut against the shoulder 4 of the casing and a second annular projection 55 to define with projection 11 an annular groove 51 for securing the locking ring 16. The cylindrical member 30 has the tapered portion 52 which defines a protrusion 54, the recess 53 and a shoulder 56. The recess 53 is formed between the protrusion 54 and the shoulder 56. On the other hand, in the structure of FIG. 16, the slider 10 has the tapered portion 52', the recess 53' and a protrusion 54' while the cylindrical member 30 has an annular groove 51' on its inner surface for securing the locking ring 16.

The operation of the modified structure will be described with reference to FIGS. 15A through 15C. FIG. 15A shows the slider 10 positioned at its forward extremity by the action of the first spring 14. By application of thrust against the slidable tube 9 and the lead to cause the slider 10 to move to its retracted position, the tapered portion 52 is engaged with the locking ring 16. At the moment of the engagement between the two elements 16 and 52, the user can feel a progressive increase of resistance. Thereafter, when the locking ring 16 reaches the protrusion 54, namely, a reduced-diameter portion of the cylindrical member 30 as illustrated in FIG. 15B, the resistance felt by the user will become maximum. Immediately after the locking ring 16 retracts beyond the protrusion 54, the user can feel that the resistance has become minimum because the locking ring 16 is positioned, at this stage, within the recess 53. Further, the locking ring 16 which has been compressed by the protrusion 54 is returned with a "click" to its original shape as soon as the ring 16 goes beyond the protrusion 54, the click being audible to the user. Therefore, the user can release the thrust applied against the writing tip of the pencil. Even though an over-thrust should be applied against the writing tip end of the pencil to cause the projection 55 on the slider 10 against the shoulder 56 of the forward part 1*a* of the casing 1, the user can feel a great resistance after he feels the aforementioned minimum resistance, and he can stop immediately his action of applying the thrust. Therefore, any breakage of parts of the pencil due to over-thrust can be eliminated. Besides, in order to lock the slider 10 temporarily after the thrust is released as shown in FIG. 15C, the parts can be readily designed so that the engagement force between the locking ring 16 and the recess 53 is greater than the recovery force of the first spring 14. Moreover, the slider 10 is urged by the first spring 14 without any looseness while the slider is in a temporary engagement with the cylindrical member 30. In place of the locking ring 16 of resilient materials such as rubber, a C-shaped washer of an appropriate metal can be employed.

Figure 17:
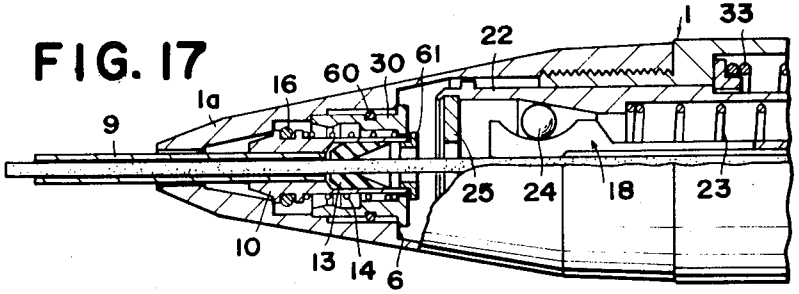
FIGS. 17 and 18 show further modifications of the slider and its associated parts.
Figure 18:
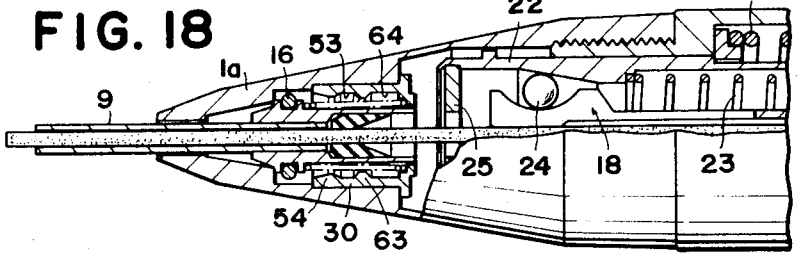
Figure 19:
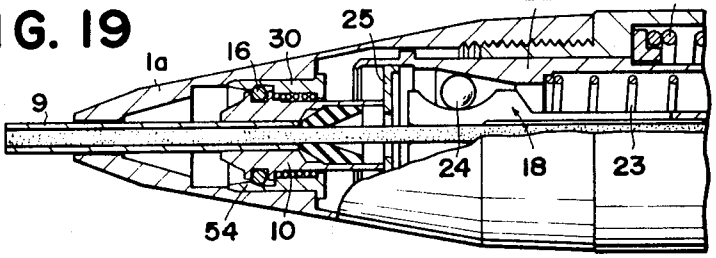
FIG. 19 shows a modified structure of a chuck-actuation cylinder in which a pusher is axially movable.

FIGS. 17, 18 and 19 show further modifications in which the slider 10 can be locked at its retracted position within the casing 1 for the purpose of preventing the lead A from projecting unexpectedly and erroneously even though a shock or pressure is applied to the tube 9 of the slider 10 when, for example, the pencil is carried in the user's pocket.

In FIG. 17, the cylindrical member 30 is axially movably mounted within the forward part 1*a*, and can be locked at a predetermined position relative to the casing 1 by means of a friction ring 60. The friction ring 60 is designed such that it has a frictional engagement force for engaging the cylindrical member 30 with the forward part 1*a* of the casing 1, the frictional engagement force being greater than the engagement force between the slider 10 and the cylindrical member 30 by means of the locking ring 16. An abutment ring 61 is fixed to the rear end of the slider 10 so that the ring 61 will contact with the rear end of the cylindrical member 30 and limit the forward movement of the slider 10. The other elements such as the collet chuck mechanism and its associated parts and structure are similar to those of the previous embodiment, and a further detailed description will not be made.

The operation of the locking of the slider 10 for the prevention of unexpected lead projection will be described. The push button (not shown) is actuated to release the grasping force of the collet 20 and to urge the chuck actuation cylinder 22 against the slider 10. Then, a thrust is applied against the writing tip end of the pencil so that the slider 10 as well as the lead A and chuck actuation cylinder 22 are retracted. Thus the slider 10 is temporarily locked at the predetermined position of the cylindrical member 30 as described with reference to the previous embodiment. If a further thrust is applied, the cylindrical member 30 is retracted against the frictional resistance produced by the friction ring 60, and finally the cylindrical member 30 is disengaged from the forward part 1*a* of the casing 1. Thus, the friction ring 60 is positioned at the rear of the shoulder 6, while the slider 10 is positioned at its temporary locking position by means of the locking ring 16, and the chuck-actuation cylinder 22 is positioned at its retracted position against a resilient force of the third spring 33.

When the aforesaid thrust is released, the chuck actuation cylinder 22 is advanced by the recovery force of the third spring 33. Similarly, both the cylindrical member 30 and slider 10 are advanced. After the movement of the elements 10, 22 and 30, the cylindrical member 30 stops further forward movement due to the friction ring 60, but the slider 10 is unlocked by the third spring 33 and is then advanced further by the first spring 14. At the same time, the chuck actuation cylinder 22 is also advanced, and contacts the rear end of the slider 10. Then the compression force added to the third spring 33 is released, and the abutment ring 61 of the slider 10 is held between the cylindrical member 30 and the pusher 25 of the chuck actuation cylinder 22. Thus the slider 10 can be locked in the retracted position.

In FIG. 18, the cylindrical member 30 is fixed to the forward part 1*a* of the casing, but has an additional protrusion 63 in addition to the protrusion 54 so that a recess 53 is formed between the two protrusions 54 and 63 for receiving the locking ring 16 temporarily. Relative to the slider, the cylindrical member 30 is designed so that the protrusion 54 engages the slider with an engagement force smaller than the recovery force of the third spring 33 while the other protrusion 63 engages the slider with an engagement force greater than the recovery force of the third spring 33. Locking of the slider is accomplished by applying a further thrust against the writing tip end of the pencil to cause the slider 10 to be retracted until the locking ring 16 is received by a recess 64 which is formed at the rear of the protrusion 63.

In FIG. 19, the slider 10 and cylindrical member 30 are similar in structure to the like elements of the previous embodiments, for example, of FIG. 15A. However, in the structure of FIG. 19, the pusher 25 is axially movable relative to, but frictionally engaged with, the chuck actuation cylinder 22. Frictional resistance between the pusher 25 and the chuck actuation cylinder 22 is designed to be greater than the frictional resistance produced between the locking ring 16 and the protrusion 54 on the cylindrical member 30, but smaller than the recovery force of the third spring 33. This structure permits the slider 10 to be locked at its retracted position similar to the embodiments of FIGS. 17 and 18.

Figure 20:
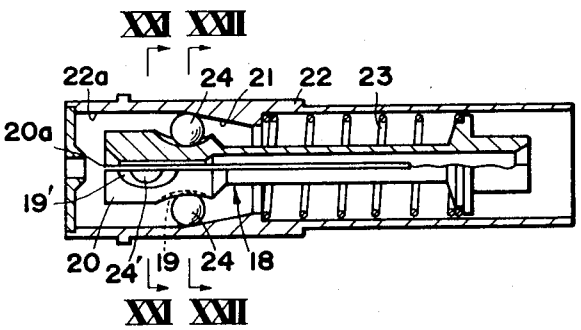
FIGS. 20, 21 and 22 show a preferred structure of a collet chuck mechanism, FIGS. 21 and 22 being sectional views taken along lines XXI—XXI, and XXII—XXII, respectively of FIG. 20.
Figure 22:
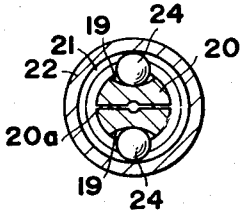
Figure 21:
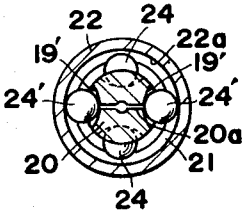

FIGS. 20, 21 and 22 show a modified structure of the collet chuck mechanism 18. The collet chuck mechanism has a lead engaging collet 20, chuck actuation cylinder 22 having a tapered guide surface 21, and a second spring 23. In this embodiment, the collet 20 has first recessed seats 19 for rotatably securing two rotary members 24 such as balls and second recessed seats 19' for rotatably securing two additional rotary members 24'. The first seats 19 are positioned in a staggered relation relative to the second seats 19' in such a manner that the first seats 19 are shifted by about 90° around the axis of the mechanism relative to the second seats 19' as best shown in FIG. 21. The provision of the additional rotary members 24' can prevent the lead engaging collet 20 from being radially moved or rattled since the collet is axially movably held on one hand by the rotary members 24, and on the other hand by the other rotary members 24' which contact a flat inner wall 22*a* of the chuck actuation cylinder 22. Preferably, the second recessed seats 19' for the retary members 24' are formed at the end portion of slits or splits 20*a* of the lead engaging collet 20 so as not to disturb the function of the collet for grasping or releasing the lead.

FIGS. 23 through 26 show additional modifications for providing the function of preventing the lead A from unexpectedly and unintentionally projecting from the slidable tube 9 when the pencil is held in the user's pocket.

Figure 23:
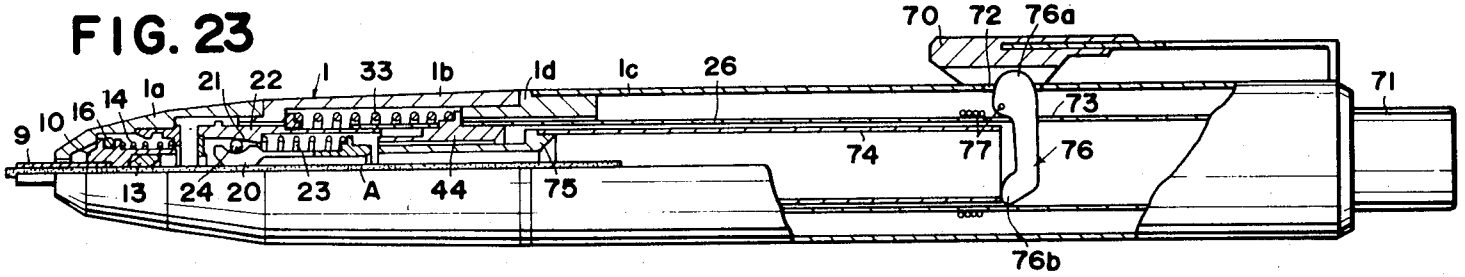
FIGS. 23 to 26 show further modifications of the pencil of the invention.
Figure 24:
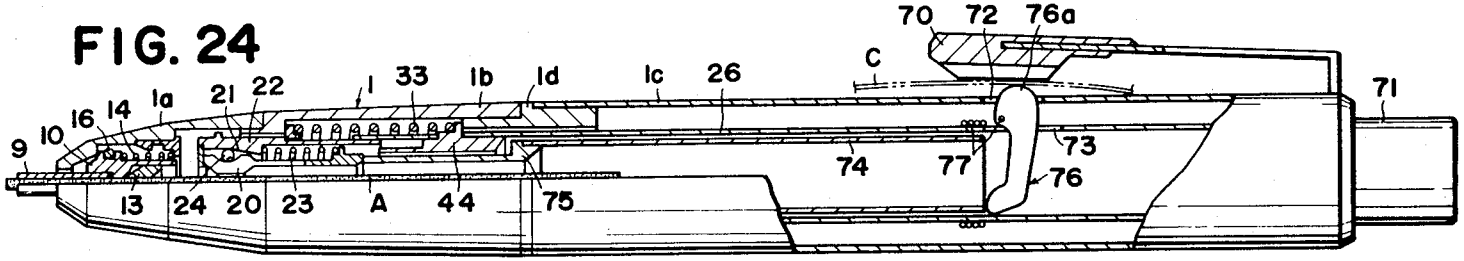

In the structure shown in FIGS. 23 and 24, a clip 70 and a push-button 71 are disposed at the rear end of the rearward part 1*c* of the casing 1 in a generally known manner. The rearward part 1*c*, which will be described simply as casing 1*c* hereinafter, has an elongated slit 72 in alignment with the clip 70. The magazine 26, which is connected with the connector 44 and frictionally engaged with the chuck actuation cylinder 22, has a slit 73 substantially aligned with the slit 72 of the casing 1*a*. The magazine 26 includes therein an inner member 74, preferably in the form of a tube, axially movably mounted within the magazine 26. The inner tube 74 has a tubular member 75, which can be integral with the tube 74, at its forward end which can abut against and push the lead engaging collet 20 when the inner tube is advanced toward the writing tip end. An actuator 76 which has a head 76*a* and a foot 76*b* is pivotally mounted on the magazine 26 by means of a supporter 77 such that the head 76*a* projects outwardly from the slit 72 while the foot 76*b* contacts the rear end of the inner tube 74, as illustrated. In the illustrated embodiment, the supporter 77 is a spring one end of which is engaged with the actuator 76 and a substantial portion of which is firmly mounted around the magazine, but the supporter 77 can be of any other suitable configuration and can be fixed to an inner wall of the casing 1*a* if the actuator 76 is pivotally mounted.

When a user places the pencil into his pocket after finishing his writing so that a cloth C of the pocket is positioned between the clip 70 and the casing 1, as illustrated. In FIG. 24, the actuator 76 is pivoted by the movement of the cloth C to cause the foot 76*b* to push the inner tube 74. Then, the lead engaging collet 20 is advanced together with the rotary members 24 which had been engaged by the tapered guide surface 21. Consequently, the lead engaging collet 20 is opened to release the lead. Therefore, even if a pressure or thrust is applied against the writing end tip such as the slidable tube 9 the pencil is carried in the pocket, the lead A will not accidentally project from the slidable tube since the collet 20 is open and does not engage the lead. In this instance, the lead A is, of course, frictionally held by the slider 10 and lead retainer 13, and the lead A does not drop out of the pencil due to its own weight.

When the pencil is removed from user's pocket for the purpose of writing, the pivoted actuator 76 is returned to its original position (FIG. 23), and the inner tube 74 and the collet 20 will be retracted to their original position by a force of the second spring 23. The inner tube 74 is made of a light weight material so that its own weight does not cause the collet to be advanced.

Other parts such as, for example, locking ring 16, cylindrical member 30, springs 14 and 33, and the relative position of these elements are substantially similar to those of the previous embodiments, particularly of the embodiment of FIG. 15A, and no further detailed description will be given.

Figure 25:
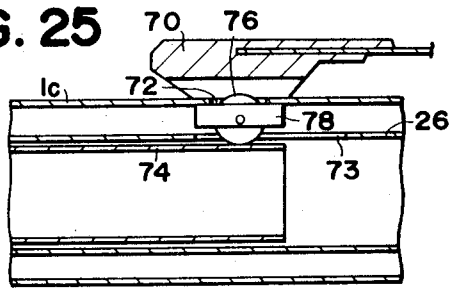
Figure 26:
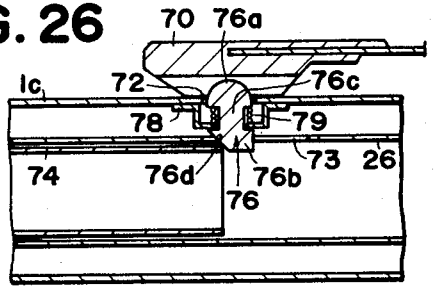

FIGS. 25 and 26 show modified forms of the actuator 76 shown in FIGS. 23 and 24. In FIG. 25, the actuator is in the form of a roller 76 rotatably supported on the casing 1*c* by a plate 78 such that a part of the roller 76 projects outwardly from the slit 72 and the other part projects inwardly from the slit 73 in the magazine 26. The roller 76 is frictionally engaged with the inner pipe 74 so that the inner pipe 74 can be advanced by the roller 76 when the roller is rotated by entry of the pocket cloth. When the inner pipe 74 is advanced, the engagement of the collet (20 of FIG. 23) with the lead is released, similar to the operation described with reference to FIGS. 23 and 24. When the pencil is removed from user's pocket, the inner pipe 74 as well as the collet will be retracted by the second spring 23 (FIG. 23) similar to the previous embodiment, but an additional spring (not shown) may be provided at a suitable position so as to facilitate the retraction of the inner tube 74. Further, application of thrust against the writing tip end of the pencil can retract the collet 20 and the inner pipe 74 to their initial position shown in FIG. 23. The inner tube 74 may have a planar shape.

In the modification shown in FIG. 26, the actuator 76 has a semi-spherical head 76*a* projecting from the slit 72 of the casing 1*c*, foot 76*b* and stem 76*c*. The actuator 76 is supported in position by a supporter 78. A helical spring 79 is disposed between the head 76*a* and foot 76*b*, and around the stem 76*c* so that the actuator is movable toward an axis of the pencil against the resilient force of the spring 79. The foot 76*b* has an inclined surface 76*d* inclined in a direction such that when the actuator is depressed by admission of user's pocket-cloth the actuator means inwardly and forciably advances the inner tube 74. Movement of the inner tube 74, of course, drives the lead engaging collet 20 (FIG. 23) toward the writing point end to release the engagement of the collet with the lead, similar to the previous embodiments. Thus, the lead will not be accidentally projected even though a thrust is applied to the writing point end when the pencil is held in the user's pocket.

Although the present invention has been described with reference to the preferred embodiments thereof, many modifications and alterations may be made within the spirit of the invention.

What is claimed:

1. A mechanical pencil comprising:

a tubular casing means;

slider means axially slidably mounted within said tubular casing means and constituted by a lead tube projecting from the writing end of said tubular casing means, a cylindrical member fixed to said lead tube, and a lead retainer mounted within said cylindrical member for frictionally holding lead therein;

first spring means mounted between said slider means and said tubular casing means and engaged only between said casing means and said slider means and biasing said slider means towards the writing end of the pencil;

collet chuck mechanism having:

a lead engaging collet axially movably mounted within said tubular casing means, a chuck actuation device axially slidably mounted between said tubular casing means and said lead engaging collet, and second spring means mounted between said chuck actuation device and said lead engaging collet and for biasing the lead engaging collet into a retracted position relative to said chuck actuation device;

third spring means in said casing means and having the forward end engaged only with said chuck actuation device for biasing said chuck actuation device towards the writing end of the pencil, said collet chuck mechanism being normally spaced from said slider means in a direction away from the writing end of the pencil and retractable against said third spring means through lead engaged within said lead engaging collet with the positional relation of said collet chuck mechanism relative to said slider means being maintained constant when said slider means is retracted;

a tubular lead magazine coaxially and slidably mounted within said tubular casing means and being coactable with said chuck actuation device;

locking means in said tubular casing means at a position adjacent said slider means and frictionally engaging said slider means when said slider means is retracted to a rearward position for holding said slider means fixed relative to said casing means in the rearward position, the frictional resistance between said locking means and said slider means being greater than the recovery force of said first spring means; and pusher means fixed to the end of said chuck actuation device which is toward said writing end for pushing said slider means for releasing the said slider means from its temporary engagement into said locking means at the rearward position to permit the slider means to move forward under the force of said first spring means, whereby when an axial thrust is applied to the writing end of the pencil, the slider means and the collet chuck mechanism are retracted within said tubular casing with their positional relation being maintained constant, and when the axial thrust against the writing end of the pencil is released, said collet chuck mechanism is advanced with the lead grasped therein to advance the lead out of the lead tube while said slider means is held at the rearward position, and then the slider means with the lead projecting therefrom is pushed by said pusher means and advanced to its initial position by the recovery force of said first spring means.

2. The mechanical pencil according to claim 1, in which said magazine has a friction tube at one end thereof, said friction tube being frictionally slidably engaged with said chuck-actuation device, said lead engaging collet comprising a reception part for receiving an axial thrust from said magazine, said third spring means being mounted between said magazine and said chuck-actuation device, said pusher means being in an axial confronting relation with said slider means with a certain distance therebetween in the normal position, said certain distance being smaller than the retracting distance of said slider means.

3. The mechanical pencil according to claim 1, in which said lead engaging collet has a plurality of recesses and rotary members rotatably held in said recesses, said chuck-actuation device being cylindrical and mounted around said lead engaging collet, said chuck-actuation device having a tapered surface coactable with said rotary members.

4. The mechanical pencil according to claim 3, in which said recesses are in a plurality of circumferential rows and the recesses in one row are circumferentially staggered relative to the recesses in the other row.

5. The mechanical pencil according to claim 1, in which an axially slidable tube member is mounted around said chuck-actuation device and extends axially over said magazine, said tube member having a forward end axially engageable with said chuck-actuation device and a rear end for receiving an end of said third spring means, said magazine having a projection around its outer surface, said projection being frictionally engaged with said rear end of the slidable tube member.

6. The mechanical pencil according to claim 1, in which said locking means is an annular member made of a resilient material.

7. The mechanical pencil according to claim 1, in which said locking means is a C-shaped member of metal.

8. The mechanical pencil according to claim 1, in which an axially slidable tube member is mounted around said chuck-actuation device, said tube member having a rear end for receiving one end of said third spring means, said rear end of the tube member being engageable with said chuck-actuation device, said chuck-actuation device being frictionally engaged with said magazine.

9. The mechanical pencil according to claim 1, in which said pencil has means for holding firmly said slider means in its retracted position relative to said tubular casing means so that the lead does not project accidentally when an unexpected thrust is applied against the writing tip end of said pencil.

10. The mechanical pencil according to claim 1, further comprising a cylindrical member fixed to the inner wall of said tubular casing means in the vicinity of said slider means, said tubular casing means having a shoulder therein defining a recess for securing said locking means therein, said slider means having a projection thereon against which one end of said first spring means abuts, the other end of said first spring means abutting said cylindrical member.

11. The mechanical pencil according to claim 1, further comprising a cylindrical member fixed to the inner wall of said tubular casing means in the vicinity of said slider means, said cylindrical member having a tapered surface, a recess and a reduced inner diameter portion slightly smaller than the outer diameter of said locking means between said tapered surface and said recess, said slider means carrying said locking means, whereby when an axial thrust is applied against said slider means sufficient to overcome the frictional resistance between said locking means and said reduced diameter portion, said slider means is retracted with an audible sound and held temporarily at its retracted position.

12. The mechanical pencil according to claim 1, further comprising a cylindrical member fixed to the inner wall of said tubular casing means, said cylindrical member having an annular recess therein holding said locking means therein, said slider means having a tapered surface, a recess and a projecting portion having a slightly larger outer diameter than the inner diameter of said locking means between said tapered surface and said recess.

13. The mechanical pencil according to claim 1, in which said pencil comprises further:

(a) a clip connected to the rear end of said tubular casing means for holding the pencil on the user's pocket, (b) said tubular casing means having a first slit therein, said first slit being positioned adjacent to and in alignment with said clip, (c) said magazine having a second slit therein in alignment with said first slit, (d) an inner tubular device freely slidable within said magazine, said inner tubular device being axially movable into engagement with said lead engaging collet for moving said collet toward the writing end of said pencil, and (e) an actuator mounted in a fixed position relative to one of said tubular casing means and said magazine, said actuator having a first portion projecting outwardly from said first slit and a second portion engageable with said inner tubular device and being movable around said fixed position for, when a pocket cloth enters the space between said clip and said tubular casing means, said actuator is moved to push said inner tubular member in a direction to advance said lead engaging collet against said second spring means, thereby releasing engagement of said lead engaging collet with the lead so that the lead is not projected accidentally when an unexpected thrust is applied against the writing end of said pencil.

14. The mechanical pencil according to claim 1, in which the force of said second spring means is smaller than the lead grasping force of said lead retainer.

* * * * *